US005223055A

United States Patent [19]

Charquet et al.

[11] Patent Number: 5,223,055

[45] Date of Patent: Jun. 29, 1993

[54] METHOD OF MAKING A SHEET OR STRIP OF ZIRCALOY WITH GOOD FORMABILITY AND THE STRIPS OBTAINED

[75] Inventors: Daniel Charquet, Albertville; Marc Perez, Levallois, both of France

[73] Assignee: Compagnie Europeenne du Zirconium Cezus, Courbevoie, France

[21] Appl. No.: 730,595

[22] Filed: Jul. 16, 1991

[30] Foreign Application Priority Data

Jul. 17, 1990 [FR] France ..... 90 09353

[51] Int. Cl.[5] ..... C22C 16/00

[52] U.S. Cl. ..... 148/672; 148/421; 420/422

[58] Field of Search ..... 148/11.5 F, 12.7 B, 148/133, 672, 421; 420/422

[56] References Cited

U.S. PATENT DOCUMENTS

| | | | |
|---|---|---|---|
| 4,584,030 | 4/1986 | McDonald et al. | 148/11.5 F |
| 4,649,023 | 3/1987 | Sabol et al. | 420/422 |
| 4,717,428 | 1/1988 | Comstock et al. | 148/11.5 F |
| 4,775,428 | 10/1988 | Bunel et al. | 148/11.5 F |
| 4,881,992 | 11/1989 | Bunel et al. | 420/421 |
| 4,981,527 | 1/1991 | Charquet | 148/11.5 F |
| 5,080,861 | 1/1992 | Garde | 420/422 |

FOREIGN PATENT DOCUMENTS

| | | |
|---|---|---|
| 0085553 | 8/1983 | European Pat. Off. . |
| 2575764 | 7/1986 | France . |
| 2578555 | 9/1986 | France . |

*Primary Examiner*—Upendra Roy

*Attorney, Agent, or Firm*—Dennison, Meserole, Pollack & Scheiner

[57] ABSTRACT

A method of making a strip of ZIRCALOY 2 or 4 is disclosed wherein an ingot is worked, roughly shaped into a billet then quenched from the beta range, hot rolled in alpha range, annealed and cold rolled to 0.3 to 0.9 mm. The O and C, in ppm, are selected to satisfy the formula: $O_2 < 1200 - 0.75 \times C$ (R) so that a T texture is obtained systematically for thicknesses of at least 0.8 mm. The disclosure also concerns the strips obtained. The method can be applied to obtaining strips of excellent formability for the production of components for nuclear water reactors.

17 Claims, 2 Drawing Sheets

METHOD OF MAKING A SHEET OR STRIP OF ZIRCALOY WITH GOOD FORMABILITY AND THE STRIPS OBTAINED

BACKGROUND OF THE INVENTION

The subject of the invention is a method of making a strip of zircaloy 2 or 4 with good formability.

In the publication by CHARQUET D., ALHERITIERE, E., and BLANC, TG., "Cold-Rolled and Annealed Textures of Zircaloy-4 Thin Strips", Zirconium in the Nuclear Industry: Seventh International Symposium ASTM STP 936 R.B., Adamson and L.F.P. Van Swan, Eds., American Society for Testing of Materials, Philadelphia, 1987, pages 663–672, the authors state that the texture of zircaloy strips has a great effect on their mechanical properties and formability.

The T texture of crystal orientation is similar to that of pure zirconium; in it the base poles (0002) are typically disoriented by 20° to 40° towards the transverse direction, while the [1120] is parallel to the rolling direction. The T texture has a better breaking load, creep strength and deformability (bending or stretch forming) than so-called C textures (centred isotrope) or L textures (base poles swung towards the rolling direction). The effect of cold rolling and annealing on texture is also discussed in this document; a return to a T structure is no longer possible once an L or C structure has been obtained.

An initial T structure is obtained by hot rolling in the alpha range, but the preservation of a T structure through cold rolling and annealing cycles is uncertain.

Applicants have sought to define the conditions which will ensure that the T structure is preserved, so that the formability of the corresponding strips of ZIRCALOY 4 or ZIRCALOY 2 can be improved systematically.

It will be recalled that the composition of these two alloys is given in the ASTM B 352-79 specifications; ZIRCALOY 4 and ZIRCALOY 2 correspond respectively to grades R 60804 and R 60802.

SUMMARY OF THE INVENTION

The subject of the invention is a method of making a strip of ZIRCALOY 2 or 4 with good formability in which—in a manner known from the above-mentioned publication—an ingot is produced and hot worked into a billet, typically by forging; the billet is heated to beta and water quenched, then hot rolled in the alpha range and annealed in the alpha range. It is then cold rolled with intermediate annealing operations, to a selected thickness from 0.3 to 0.9 mm. According to the invention, production of the ingot is carried out such that the carbon (C) and oxygen ($O_2$) content obtained thereby satisfy the formula:

(R) $O_2 < 1200 - 0.75xC$ and preferably (R') $O_2)21$ $1150 - 0.75xC$, the O and C content being expressed in ppm. The strips thus obtained have T textures systematically in the case of thicknesses of 0.8 mm and over. In cases where the final thickness has to be smaller, the three recommended preferred measures should be applied, singly or combined generally:

(a) hot rolling the billet at the top of the alpha range with rolling starting at a temperature of from 730° to 795° C.;

moderating the annealing operations to keep the texture obtained by the following means:

(b) carrying out the annealing operation which follows hot rolling at a temperature below 640° C.;

(c) carrying out each intermediate annealing operation between cold rolling either at from 600° to 640° C. for 3 and 4 hours, or at from 650° to 700° C., for 1 to 5 minutes, or with any other (temperature, time) pair which gives an annealing result (hardness, recrystallisation) equivalent to either intermediate annealing operation.

To obtain a strip 0.6 mm thick, it is preferable to carry out three cold rolling/annealing cycles; thus there are two intermediate annealing operations. For a thickness of 0.4 mm, 3 or 4 cold rolling/annealing cycles are carried out, so there are 2 or 3 intermediate annealing operations.

The solution to formula (R) surprising enables a T texture to be obtained in a strip at least 0.8 mm thick, and this is obtained whether the strip is work hardened or in an annealed state. It also enables the T texture to e preserved with smaller thicknesses, if the clearly defined methods (a), (b), and(c) are followed. In the case of ZIRCALOY 4, maintenance of the T texture goes together with the presence and maintenance of precipitates based on (Fe, Cr), which also give an improvement in the resistance to uniform corrosion in water of PWR reactors.

The range defined by (R) is normally limited by the maximum C content defined by ASTMB specification 352, namely 270 ppm. Obtaining the minimum mechanical properties required for some types of strip for the production of grids holding nuclear fuel elements (see U.S. Pat. No. 4,717,427 and EP 246986=U.S. Pat. No. 4,881,992: $E_{0.2}$ at 315° C.≧250 MPa, breaking load 315° C.≧280 MPa), and the wish to avoid Zr carbide precipitation leads (sic) to the following complementary preferred limitations:

$$C \leqq 180 \text{ ppm and } O_2 \geqq 600 \text{ ppm},$$

which respectively enhance ductility and increase mechanical strength at 315° C., taking into account the texture produced by formula (R). If the best possible formability is to be obtained, it is advisable for the selection of (C) and ($O_2$) content according to the invention to be combined with the cold rolling conditions already described by Applicants:

either, in accordance with FR 2 575 764, carrying out the last rolling process with deformation of from 30 to 55% and the final annealing operation at from 490° to 580° C. for 1 to 10 minutes, thereby obtaining incipient recrystallisation, which typically involves 0.5 to 5% of the volume of the strip;

or, in accordance with EP 246986=U.S. Pat. Nos. 4,775,428 and 4,881,992 (mentioned above), and as an alternative form of method (c), with cold rolling processes and intermediate annealing operations adjusted so as to have intermediate states where the alloy is just recrystallised with very fine grains: carrying out cold rolling with at least two intermediate annealing operations and a final annealing operation, each of the two intermediate ones being from 0.5 to 10 minutes at from 650° to 750° C., the amount of deformation between annealing operations being from 20 to 55% before the penultimate one, from 30 to 55% between the last two intermediate ones and between the last intermediate one and the final one, the final annealing operation being from 1.5 to 7 minutes at from 590° to 630° C. and producing partial recrystallisation of the strip obtained, involving 20 to 40% of its volume.

In these cold rolling methods each amount of deformation is calculated by the formula:

$(1-e/E)\times 100$ where e and E are respectively the thicknesses after and before rolling.

It will be seen from the tests that, when the 0 content (ppm) is increased above (1150−0.75xC), L textures are obtained, or T textures which are easily degraded by cold rolling. When the 0 content is only increased thus by less than 200 to 250 ppm relative to (1150−0.75xC), the T texture can still be obtained provided that the transformation conditions are selected, whereas beyond that increase only L texture is possible.

It should be noted, of the products obtained according to the invention, two grades of strip are particularly important:

A. Annealed strips of ZIRCALOY 2 or 4 from 0.3 to 0.9 mm thick, which satisfy the mechanical properties at 288° C. (550° F.) laid down by ASTM specification 352:

| | |
|---|---|
| breaking load in longitudinal direction (L) | 186 MPa |
| breaking load in transverse direction (T) | 179 MPa |
| and elastic limit at 0.2% (YS) in direction (L) | 103 MPa |
| and elastic limit at 0.2% (YS) in direction (T) | 120 MPa |
| having a T texture with $0_2 \geqq 700$ ppm and $0_2 < 1150 - 0.75$xC.; | |

B. Strips of annealed ZIRCALOY 2 or 4 with incomplete recrystallisation or "restored" strips, again from 0.3 to 0.9 mm thick, satisfying the following minimum mechanical properties:

$E_{0.2}$ at 315° C.:250 MPa, breaking load R in direction (L) 310 MPa, and also having a T texture with $O_2 \geqq 700$ ppm and $O_2 < 1150-0.75$xC.

The amount of recrystallisation is then 0.5 to 40% of the volume.

The essential advantage of the invention is that it systematically gives strips of ZIRCALOY 4 or ZIRCALOY 2 with the required level of mechanical properties and excellent formability. Formability can typically be assessed by testing their suitability for drawing operations, for example by the ERICHSEN tests. The improvement in formability is accompanied by an improvement in resistance to uniform corrosion.

DESCRIPTION OF THE PREFERRED EMBODIMENTS

The following examples concern sheets or strips of ZIRCALOY 4, obtained from a plurality of casting operations, the numbers of which are given in Table 1.

Figure 1:
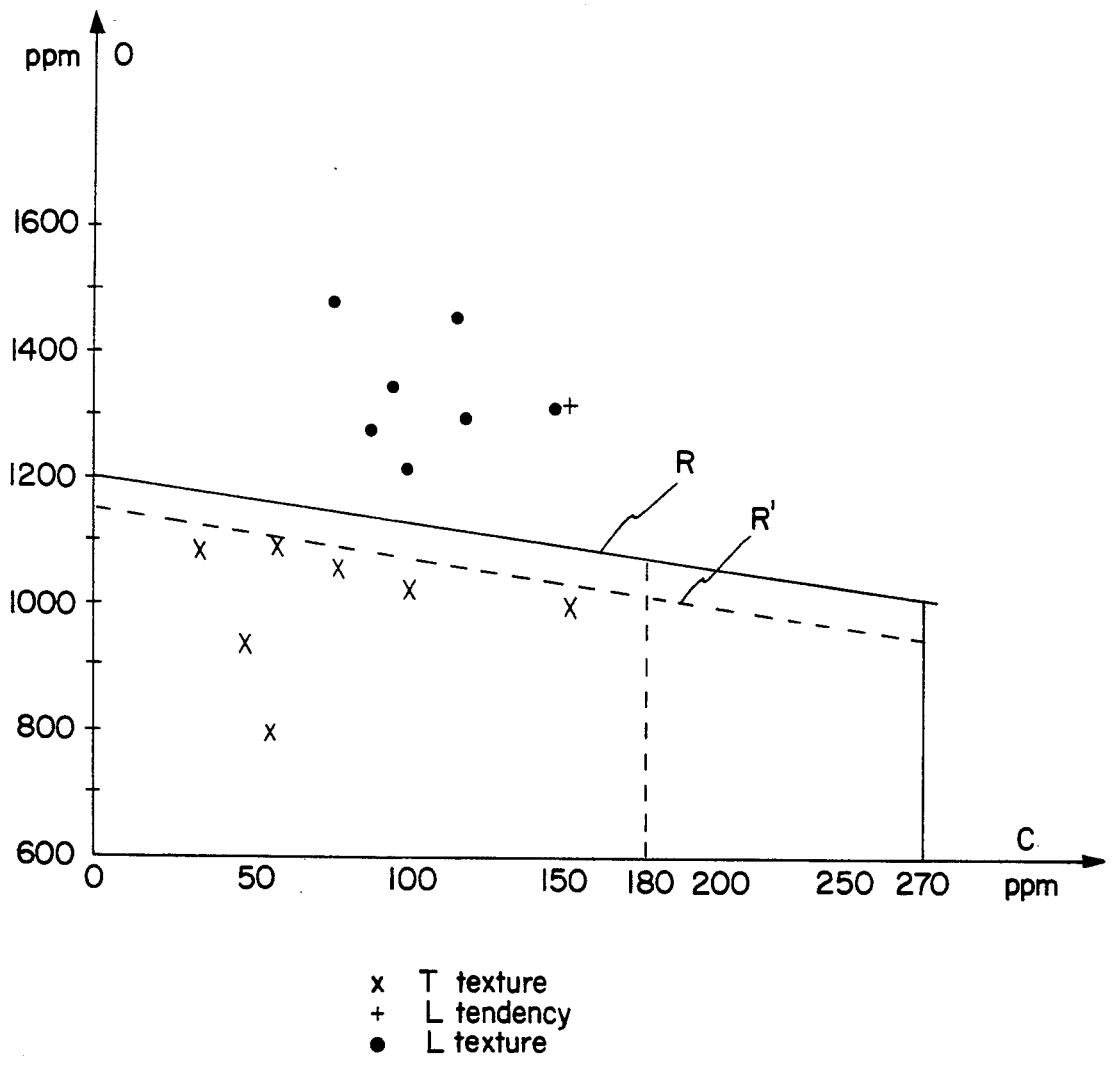
FIG. 1 is a graph showing the compositions of sheets or strips of Table 1.

The graph in FIG. 1 shows the content pairs (C,O) of the various sheets or strips in Table 1, with the straight lines forming the limits of formulas (R) and (R') shown respectively as R and R'.

Figure 2:
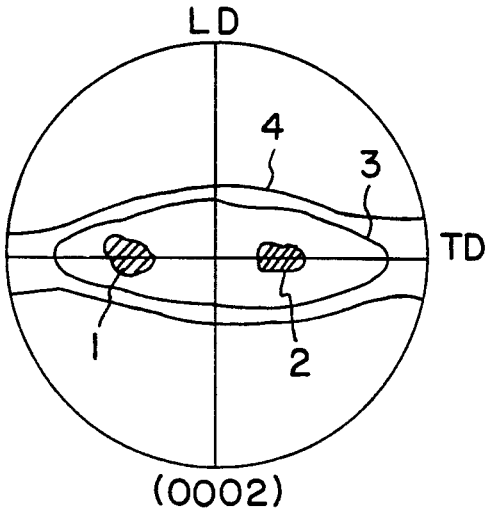
FIG. 2 is a diagram of a T texture.
Figure 3:
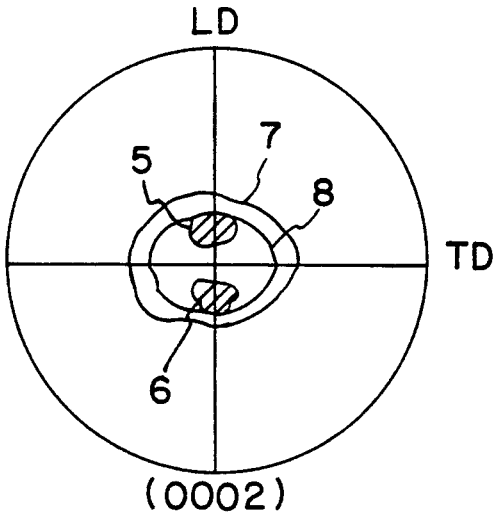
FIG. 3 is a diagram of an L texture.

FIG. 2 represents a T texture and FIG. 3 an L texture; these two diagrams are taken from the publication quoted t the beginning of this specification.

The texture in FIG. 2, described as a "T texture", has two base poles (0002) 1 and 2 which are disoriented by 20° to 40° in the transverse direction TD. There are two curves of relative maxima 3 and 4.

The so-called "L texture" in FIG. 3 is very different: the two base poles 5 and 6 are disoriented by 10° to 20° in the rolling direction LD, while the relative maxima 7 and 8 surround the poles 5 and 6 and are closer to them.

In all cases the ingot is roughly shaped hot into a billet, the billet is quenched from beta range then hot rolled in the alpha range to a thickness of o4 to 6 mm, and the rolled ingot or rough rolled strip is annealed at 630° C.

As indicated in the above-mentioned publication, recrystallisation of a cold rolled material with a T texture does not markedly change the orientation of the base poles (002). Conversely, when an L texture or a centred texture has been obtained it is not possible to return to a T texture, for example trough annealing.

Samples 1 to 6 and 8 in Table 1, which have an O and C content complying with formula (R) and with preferred formula (R'), have a T texture at a thickness of 0.8 mm, either in the annealed state (Samples 1 to 5 and 8) or in the work hardened state (Sample 6): as indicated above, the T texture is that of all the samples both in the work hardened and annealed state.

Sample 7 (0.4 mm thick) illustrates the fact that with further cold rolling the texture may change to an L texture. The change is very evident in this case.

In the case of Sample 10, which is examined at a thickness of 2 mm in the annealed state and a thickness of 1.2 mm in the work hardened state, the change in texture with rolling is premature in view of the strip thicknesses used for spacing grids of nuclear fuel elements (0.3 to 0.9 mm thick).

Samples 9 and 11 to 15 show that, in the case of thicknesses from 0.4 mm to 1.5 mm, an L texture is observed, the corresponding (C,N) pairs being located above the limit line R (FIG. 2).

APPLICATIONS

The invention makes it possible to obtain sheets and strips of ZIRCALOY 4 or ZIRCALOY 2 with excellent formability, for producing components for use in nuclear water reactors of the PWR or BWR type, for example spacing grids or casings.

TABLE 1

| SAMPLE REF. | CASTING NO. | O (ppm) | C (ppm) | TYPE OF TEXTURE | THICKNESS (mm) | STATE AND METHOD OF OBTAINING IT |
|---|---|---|---|---|---|---|
| 1 | 30 | 790 | 57 | T | 0.8 | Annealed (2 mm) |
| 2 | 48 | 930 | 49 | T | 0.8 | " |
| 3 | 978 | 1000 | 155 | T | 0.8 | " |
| 4 | 85 | 1025 | 102 | T | 0.8 | " |
| 5 | 82 | 1060 | 80 | T | 0.8 | " |
| 6 | 33 | 1090 | 35 | T | 0.8 | Work hardened (2 mm) |

TABLE 1-continued

| SAMPLE REF. | CASTING NO. | O (ppm) | C (ppm) | TYPE OF TEXTURE | THICKNESS (mm) | STATE AND METHOD OF OBTAINING IT |
|---|---|---|---|---|---|---|
| 7 | " | " | " | ? | 0.4 | " |
| 8 | 58 | 1095 | 60 | T | 0.8 | Annealed (2 mm) |
| 9 | 86 | 1210 | 101 | L | 0.6 | Partially annealed (0.5 to 5% recrystallised) |
| 10 | 87 | 1320 | 150 | T/L | 2/1.2 | Annealed/work hardened |
| 11 | 79 | 1285 | 90 | L | 1.0 | Work hardened (2 mm) |
| 12 | 25 | 1300 | 120 | " | 0.8 | Partially annealed |
| 12 bis | " | " | " | L | " | Work hardened (2 mm) |
| 13 | 10 | 1350 | 96 | L | 1.5 | Work hardened (2 mm) |
| 14 | 17 | 1430 | 114 | L | 1.2 | Work hardened (2 mm) |
| 15 | 678 | 1490 | 77 | L | 0.4 | Work hardened (2 mm) |

What is claimed is:

1. A method of making a strip of zircaloy 2 or 4 with good formability, comprising the steps of producing an ingot, hot working the ingot to form a billet, quenching the billet from beta range, hot rolling the quenched billet in alpha range, then annealing and cold rolling with intermediate annealing operations to form a strip having a thickness from 0.3 to 0.9 mm;

wherein the production of the ingot is carried out such that:

$$O_2<(1200-0.75C),$$

$O_2$ and C being expressed in ppm.

2. The method of claim 1 wherein $$O_2<1150-0.75xC$$

3. The method of claim 1 or 2, wherein $C \leqq 270$ ppm.

4. The method of claim 1 or 2, wherein the billet is hot rolled to a thickness from 3 to 6 mm at the top of the alpha range, the temperature at which rolling is commenced being from 730° to 795° C.

5. The method of claim 3, wherein the billet is hot rolled to a thickness from 3 to 6 mm at the top of the alpha range, the temperature at which rolling is commenced being from 730° to 795° C.

6. The method of claim 4, wherein cold rolling is carried out with at least one intermediate annealing operation, each intermediate annealing operation being at from 600° to 640° C. for 3 to 4 hours.

7. The method of claim 4, wherein the last cold rolling step is carried out with deformation of 30 to 55%, and wherein the rolled strip is then subjected to a final heat treatment for 1 to 10 minutes at from 490° to 580° C., thus giving a strip which is partially recrystallized over 0.5 to 5% of its volume.

8. The method of claim 4, wherein cold rolling is carried out with at least two intermediate annealing operations and a final annealing operation, each of the two intermediate ones being for 0.5 to 10 minutes at from 650° to 750° C., the amount of deformation between these operations being from 20 to 55% before the penultimate intermediate annealing operation, from 30 to 55% between the last two intermediate ones and between the last intermediate one and the final one, the final annealing operation being for 1.5 to 7 minutes at from 590° to 630° C. and then producing partial recrystallization of the strip obtained, involving 20 to 40% of its volume.

9. The method of claim 4, wherein cold rolling is carried out with at least one intermediate annealing operation, each intermediate annealing operation being at from 650° to 700° C. for 1 to 5 minutes.

10. The method of claim 4, wherein the annealing operation which follows hot rolling is carried out at a temperature below 640° C.

11. The method of claim 10 wherein the thickness at the end of cold rolling is less than 0.8 mm, and wherein cold rolling is effected with at least two intermediate annealing operations, each intermediate annealing operation being at from 600° to 640° C. for 3 to 4 hours.

12. The method of claim 10, wherein cold rolling is carried out with at least one intermediate annealing operation, each intermediate annealing operation being at from 600° to 640° C. for 3 to 4 hours.

13. The method of claim 10 wherein the thickness at the end of cold rolling is less than 0.8 mm, and wherein cold rolling is effected with at least two intermediate annealing operations, each intermediate annealing operations being at from 650° to 700° C. for 1 to 5 minutes.

14. The method of claim 10, wherein the last cold rolling step is carried out with deformation of 30 to 55%, and wherein the rolled strip is then subjected to a final heat treatment for 1 to 10 minutes at from 490° to 580° C., thus giving a strip which is partially recrystallized over 0.5 to 5% of its volume.

15. The method of claim 10, wherein cold rolling is carried out with at least two intermediate annealing operations and a final annealing operation, each of the two intermediate ones being for 0.5 to 10 minutes at from 650° to 750° C., the amount of deformation between these operations being from 20 to 55% before the penultimate intermediate annealing operations, from 30 to 55% between the last two intermediate ones and between the last intermediate one and the final one, the final annealing operation being for 1.5 to 7 minutes at from 590° to 630° C. and then producing partial recrystallization of the strip obtained, involving 20 to 40% of its volume.

16. A method of making a strip of zircaloy 2 or 4 with good formability, comprising the steps of producing an ingot, hot working the ingot to form a billet, quenching the billet from beta range, hot rolling the quenched billet in alpha range, then annealing and cold rolling with intermediate annealing operations to form a strip having a thickness from 0.3 to 0.9 mm;

wherein the production of the ingot is carried out such that:

$$O_2<(1200-0.75C),$$

$O_2$ and C being expressed in ppm, and wherein $O_2 \leqq 660$ ppm and $C \leqq 180$ ppm.

17. The method of claim 16, wherein the billet is hot rolled to a thickness from 3 to 6 mm at the top of the alpha range, the temperature at which rolling is commenced being from 730° to 795° C.

* * * * *